US005848694A

United States Patent [19]

Newton

[11] Patent Number: 5,848,694

[45] Date of Patent: Dec. 15, 1998

[54] TOOL CARRIER

[76] Inventor: Harold L. Newton, 20000 SW. 224 St., Goulds, Fla. 33170-3209

[21] Appl. No.: 20,498

[22] Filed: Feb. 9, 1998

[51] Int. Cl.[6] ..... B65D 85/28

[52] U.S. Cl. ..... 206/373; 206/378; 206/483; 211/70.6; 220/768

[58] Field of Search ..... 206/378, 372, 206/373, 376, 377, 493, 478, 480, 483, 564, 565, 557; 211/70.6; 220/735, 752, 768, 529

[56] References Cited

U.S. PATENT DOCUMENTS

| | | | |
|---|---|---|---|
| D. 157,776 | 3/1950 | Naken | 206/373 |
| 3,618,749 | 11/1971 | Vaccaro . | |
| 3,892,331 | 6/1975 | Beck . | |
| 4,353,465 | 10/1982 | Rado | 206/378 |
| 4,714,158 | 12/1987 | Oltman . | |
| 4,927,020 | 5/1990 | Randy | 206/378 |
| 5,011,013 | 4/1991 | Meisner et al. | 206/373 |
| 5,117,979 | 6/1992 | Brightbill | 206/373 |
| 5,228,570 | 7/1993 | Robinson | 206/378 |
| 5,284,245 | 2/1994 | Slivon et al. | 206/378 |
| 5,368,164 | 11/1994 | Bennett et al. | 206/373 |
| 5,398,823 | 3/1995 | Anders | 206/378 |
| 5,409,560 | 4/1995 | Hammer et al. | 206/378 |
| 5,415,277 | 5/1995 | Berntsen . | |
| 5,526,929 | 6/1996 | Wei . | |
| 5,573,116 | 11/1996 | Zink . | |

*Primary Examiner*—Paul T. Sewell
*Assistant Examiner*—Nhan T. Lam
*Attorney, Agent, or Firm*—Alvin S. Blum

[57] ABSTRACT

A tool carrier has a top portion with an upstanding handle and slidably mounted clips for engaging sockets and fixed spring clips for securely holding socket wrenches, ratchet handles, adapters and the like. Two opposed sides depend from the top portion and support a lower panel provided with upstanding resilient fibers such as outdoor carpet. When elongate items such as an assortment of end wrenches are pushed into the space between the top portion and the panel, the fibers securely hold the items in place with their ends exposed for easy selection. An optional drawer may be slidably mounted beneath the panel. The carrier is adapted for mounting in a toolbox.

8 Claims, 2 Drawing Sheets

TOOL CARRIER

BACKGROUND OF THE INVENTION

This invention relates to article carriers, and more specifically to a handled carrier for an assortment of socket wrenches and other wrenches that may fit into a toolbox.

Conventional toolboxes may be provided with a handled tray that fits inside the box and is supported above the box contents in the upper portion of the box by ridges or projections from the box sides. In addition to the many tools that the mechanic usually carries in a toolbox, there is often need for wrenches of various types and sizes. End wrenches come in various sizes and styles including open end; adjustable open end; box; and combinations thereof. These may be provided in sets in a specially compartmented box or purchased separately and stowed in the toolbox. Socket wrenches are generally purchased and carried in a set that is provided in a box with a special recess for each socket so that a correct size is easily selected. Recesses hold the various wrench handles and attachments for the sockets. Upsetting the box may mix and scatter the contents. It is awkward and inconvenient for a person to carry a toolbox and also a socket wrench box and an end wrench box.

SUMMARY OF THE INVENTION

It is accordingly an object of the invention to provide a carrier for a set of socket wrenches and end wrenches that may be carried about by a handle in a secure configuration and that may also be carried about in a toolbox. The tool carrier of the invention comprises an upper portion on which are mounted a carrying handle, a plurality of spring clips for holding various socket wrench accessories, and a plurality of slideably mounted supports for removably holding sockets upright. Spaced apart from the upper portion and below it is mounted a lower panel that holds a web. The web is provided with resilient upstanding fibers such as found on an outdoor carpet that substantially occupy the space between the upper portion and the lower panel. This space removably holds a plurality of end wrenches such as open end, box, and adjustable end wrenches and combinations thereof. The wrench is simply pushed into the space, and the fibers bend away and resiliently grip the wrench. To use a wrench it is simply pulled out by its protruding end. To use a socket and a socket wrench or attachment, they are simply pulled up from their resilient holders.

These and other objects, advantages and features of the invention will become more apparent when the detailed description is studied in conjunction with the drawings in which like reference characters designate like elements in the various drawing figures.

DETAILED DESCRIPTION OF PREFERRED EMBODIMENTS

Figures 1, 3:
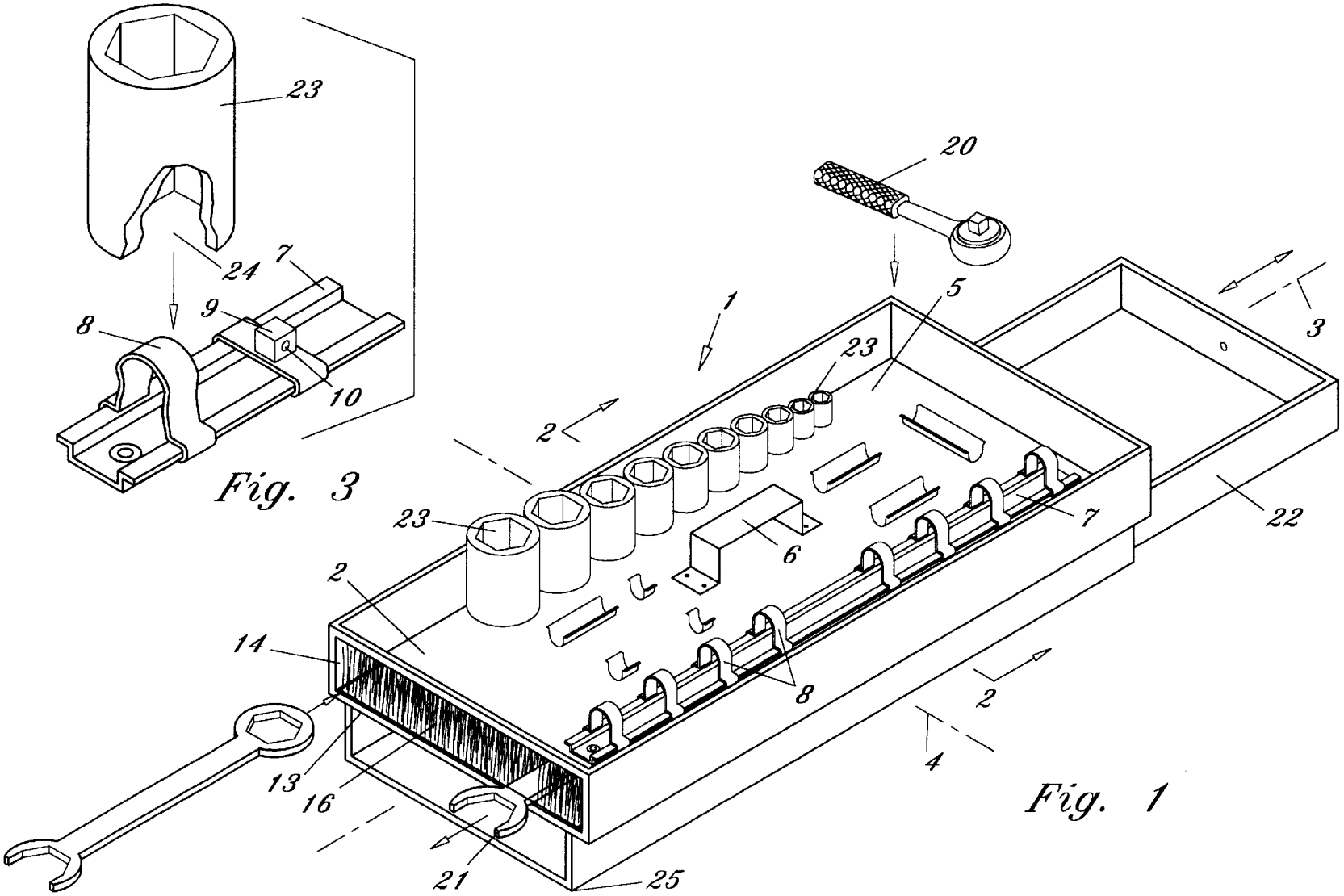
FIG. 1 is a top perspective drawing of a tool carrier of the invention.
FIG. 3 is a detail perspective view of two different socket receivers slidably mounted on a support element.
Figure 2:
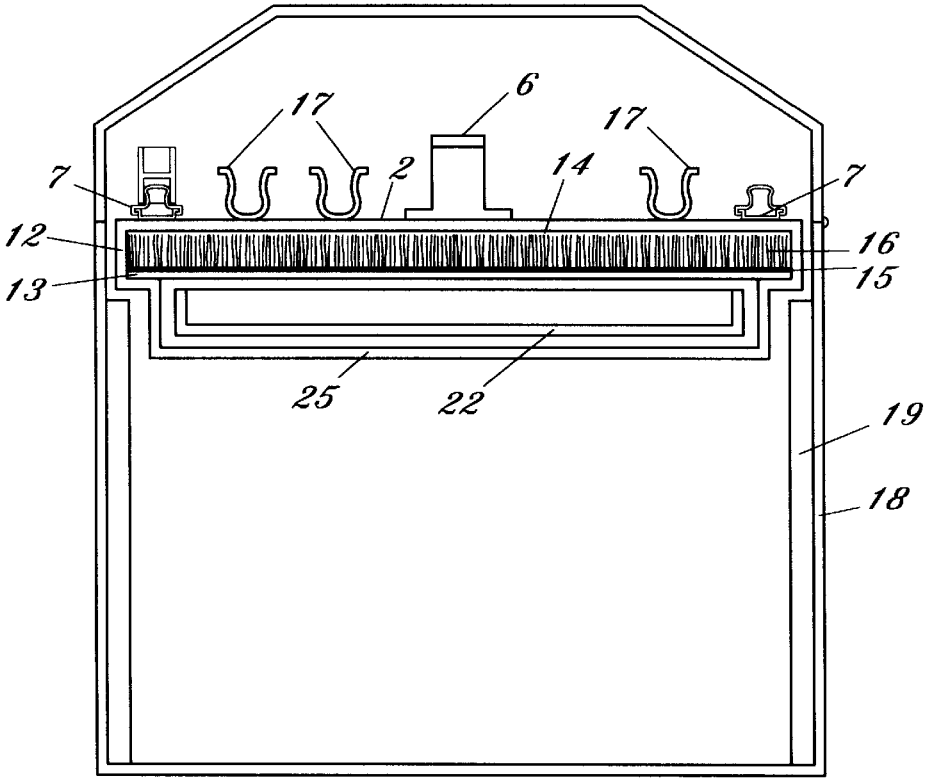
FIG. 2 is a sectional view through line 2—2 of FIG. 1 showing the tool carrier inside a toolbox.

Referring now first to FIGS. 1–3, the tool carrier 1 of the invention provides a secure holder for sets of sockets 23, socket wrench elements such as extensions and adapters (not shown) and ratchet handles 20 for use with the various size sockets. The carrier also securely holds a variety of elongate items such as the many varieties of end wrenches such as fixed open end, adjustable open end, box wrenches and combinations thereof. These are all provided in easily seen positions so that they may be selected for use without having to rummage through a cluttered toolbox. They are held securely in position by resilient engagement with holding means so that if the carrier is upset, the various items remain in place. The carrier is provided with a centrally located handle 6 for carrying it about. It is also adapted for resting inside a toolbox 18 where it rests on projections 19 above the box contents in much the same manner as conventional tool trays that are provided with many toolboxes.

The carrier comprises an upper portion 2 having a broad surface area 5 with a long axis 3 and a short axis 4. A plurality of elongate support elements 7 are fastened to the surface 5. Slidably mounted on the support elements 7 are resilient receiver clips 8 for removably receiving the sockets 33 and holding them with spring bias. The clips 8 slide easily to adjust for spacing to accommodate sockets of different sizes. The sockets all have recesses 24 of the same size to fit the various wrenches 20. The resilient clip 8 compresses as the socket is forced over it. This holds the socket and also causes the grip of the clip on support 7 to tighten so that it doesn't slide about. An alternative socket clip 9 features a spring loaded ball detent 10. Also mounted atop upper portion 2 are a plurality of spring clips 17 of various sizes that are adapted for resiliently and removably engaging various wrenches and adapters such as those that are normally used with the sockets as exemplified by ratchet handle wrench 20.

Depending from upper portion 2 are two opposed sides 12. These are joined to lower panel 13, to define a broad shallow space 14 between the upper portion and the lower panel. On the lower panel is mounted a broad web 15 provided with resilient upstanding fibers 16. Outdoor carpeting has been found to be useful for this purpose. When elongate items such as the various end wrenches are pushed into the space 14, the fibers are bent down and resiliently hold the wrench up against the upper portion so that they will not fall out when the carrier is tilted. The end of the wrench 21 is left protruding so that it is easily seen and selected. Because both open ends of the space 14 are available, a large number of wrenches of assorted styles and sizes may be carried and displayed at once.

The carrier 1 may optionally be provided with a drawer 22 that is slidably mounted on an optional drawer support 25 that is hung below the lower panel.

Figure 4:
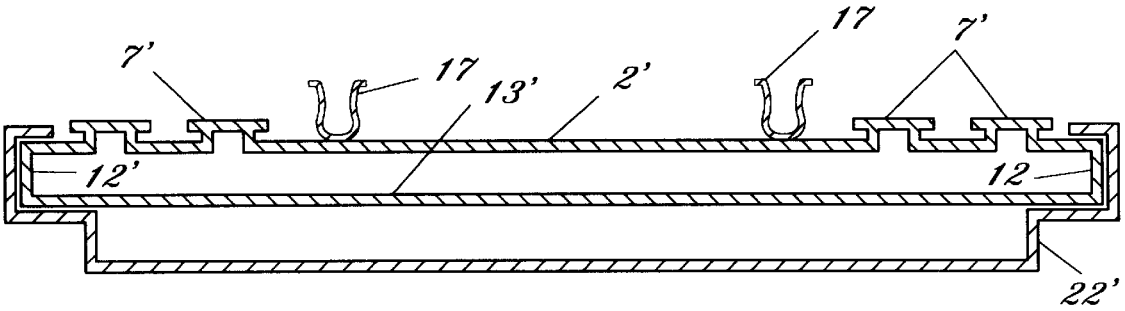
FIG. 4 is a sectional view of another embodiment of the invention.

Referring now to FIG. 4, an alternative construction is shown in which the elongate support elements 7', the upper portion 2', spring clips 17' and sides 12' and lower panel 13' are all integrally formed such as by extrusion. The drawer 22' is slidably mounted directly on the upper portion so that when it is not used, there is no projection below the lower panel.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A tool carrier comprising:

an upper portion having a broad surface area with a long axis and a short axis;

a handle affixed to the upper portion and extending upward therefrom;

a plurality of elongate support elements affixed to the upper portion and extending upward therefrom;

a plurality of receiver means for removably attaching to sockets, each receiver means being slidably mounted on one of said support elements and provided with spring bias means for securely holding thereon a socket;

two parallel opposed sides attached to the upper portion and extending downward therefrom;

a lower panel attached to the two sides and disposed beneath and parallel to the upper portion and spaced apart therefrom to define a broad shallow space therebetween with open ends parallel to the short axis;

a broad web bearing upstanding resilient fibers mounted on the lower panel;

the fibers cooperating with the upper portion to removably grip elongate items inserted through one of the open ends, and a plurality of spring clip means affixed to the upper portion and extending upward therefrom for removably engaging socket wrench elements.

2. The tool carrier according to claim 1, further comprising a drawer support connected to the two sides and a drawer member supported by the drawer support below the lower panel and constructed for sliding in a direction parallel to the long axis.

3. The tool carrier according to claim 2, in which the web is outdoor carpet and the elongate items are end wrenches.

4. The tool carrier according to claim 3 provided with means for mounting in a toolbox.

5. The tool carrier according to claim 2 provided with means for mounting in a toolbox.

6. The tool carrier according to claim 1, in which the web is outdoor carpet and the elongate items are end wrenches.

7. The tool carrier according to claim 6 provided with means for mounting in a toolbox.

8. The tool carrier according to claim 1 provided with means for mounting in a toolbox.

* * * * *